US005096135A

United States Patent [19]

Eichenberger et al.

[11] Patent Number: 5,096,135

[45] Date of Patent: Mar. 17, 1992

[54] TRANSPORT DEVICE FOR LAPS

[75] Inventors: Hansulrich Eichenberger, Winterthur; Paul Scheurer, Andelfingen, both of Switzerland

[73] Assignee: Rieter Machine Works, Ltd., Winterthur, Switzerland

[21] Appl. No.: 571,149

[22] Filed: Aug. 23, 1990

[30] Foreign Application Priority Data

Aug. 23, 1989 [CH] Switzerland ..... 03058/89

[51] Int. Cl.[5] ..... B65H 19/12

[52] U.S. Cl. ..... 242/58.6; 414/746.4; 414/911

[58] Field of Search ..... 242/58.6, 79; 414/222, 414/376, 381, 746.4, 910, 911

[56] References Cited

U.S. PATENT DOCUMENTS

| | | | |
|---|---|---|---|
| 1,926,261 | 9/1933 | Burnish | 414/746.4 |
| 3,895,725 | 7/1975 | Mayer | 57/53 |
| 3,987,974 | 10/1976 | Mayer | 242/35.5 A |
| 4,487,545 | 12/1984 | Schonmeier | 414/746.4 |
| 4,892,610 | 1/1990 | Sano | 242/58.6 X |
| 4,903,910 | 2/1990 | Tamura | 242/58.6 X |
| 4,948,060 | 8/1990 | Kurz et al. | 242/58.6 X |

FOREIGN PATENT DOCUMENTS

| | | |
|---|---|---|
| 1088396 | 9/1960 | Fed. Rep. of Germany . |
| 0163248 | 8/1933 | Switzerland . |
| 0347745 | 8/1960 | Switzerland . |
| 0423566 | 5/1967 | Switzerland . |
| 1044677 | 10/1966 | United Kingdom . |

OTHER PUBLICATIONS

Kammerereivorbereitung UNILAP, publication of Rieter Machine Works, Ltd., of Winterthur, Switzerland (undated).

Super Lap 810, publication of Zinser Company, of The Federal Republic of Germany, (undated).

*Primary Examiner*—John M. Jillions

*Attorney, Agent, or Firm*—Sandler, Greenblum & Bernstein

[57] ABSTRACT

A transport device serves for the delivery of a plurality of tubes wound with textile material to form laps, between a lap forming machine and a lap processing machine, by means of a transport truck. The transport truck possesses a tiltable receiver in which repose the laps. Viewed in the lengthwise direction of the laps, the latter are arranged behind and coaxially with respect to one another at a predetermined mutual spacing. With prior art devices, a number of manual operations are required to accomplish the exchange of laps and empty tubes. In particular, the empty tubes must be manually removed and intermediately stored at the lap processing machine before they can be manually placed upon the transport truck following mounting of the full laps. The invention thus proposes a transport device which enables automatically transferring the tubes into a receiver trough of the transport truck, and following release of a locking device with concomitant release of the tiltable receiver, the laps can be automatically introduced into a receiver location of a combing machine constituted by the lap processing machine.

22 Claims, 3 Drawing Sheets 1
2
3
4
5
6
7
8
9
10
11
11
12
13
14,14a
15
16
17
18,18a
19
20
21
22
23
100

CENTRAL CONTROL
MASTER COMPUTER
DRIVE CONTROL
VALVE
VALVE
A

TRANSPORT DEVICE FOR LAPS

BACKGROUND OF THE INVENTION

1. Field of the Invention

The present invention relates to a new and improved transport device for the delivery of several tubes wound with a textile material, for example, laps from a lap formation or forming machine to a lap processing machine, by means of a transport truck, which has an installation or receiver for reposingly receiving the laps, whereby, viewed in the longitudinal direction of the transport truck, these laps are deposited one behind each other and coaxially with respect to each other at a predetermined spacing or distance. In order to deliver the laps, the transport truck is fixed to the lap processing machine in a predetermined position by guide or positioning devices 2. Discussion of Background and Other Information The demands for an automated spinning mill are continually becoming more important in practice.

This not only relates to the sequence of operations on the individual machines, but also to the transport of textile material between the individual stages of the process, particularly as the units or items to be transported are continually becoming larger and thus heavier.

Therefore, various proposals also have been made in order to transport the lap rolls or laps, which can have a weight of up to 25 kilograms and more, from a lap formation or forming machine, for example, Unilap Machine of Reiter Machine Works Ltd., located at Winterthur, Switzerland (Combing Preparation Prospectus, in Print No. 13 43 d-0987) to a subsequent combing machine In this connection, an overhead trolley system is used, and several laps are simultaneously brought by transport rails to the combing machine, in the example shown, four laps, which are then deposited at that location.

This overhead transport system and others offer a very reliable, easy to operate and material-protecting transport device; however, they require a large investment, as well as corresponding head room.

Simpler and cheaper systems have been realized for this purpose, by means of which a number of laps located on a transport truck are guided upon the floor to the combing machine (Prospectus of Zinser Company of West Germany, concerning the Super Lap 810).

In this connection, a transport truck is provided with a longitudinal receiver, for instance, a transport cradle, which is loaded, at the lap formation or forming machine (Super Lap), with four laps at predetermined chronological intervals. With this operation, the transport truck is conveyed by a guide device to the lap formation machine, and is positioned, by means of a displacement device, at the proper point in time with respect to the delivery location of the lap formation machine. The laps are deposited at a predetermined spacing or distance from one another, corresponding to the pitch of the combing heads of the subsequently arranged combing machine.

After the fourth lap has been accepted, the positioning device is released and the transport truck can be manually pushed to the combing machine.

The transport truck is brought into position by a further guide or locating arrangement at the combing machine, so that there can be accomplished the exchange of the depleted tubes against full laps.

The exchange operation is carried out manually, and initially there must be removed a number of tubes corresponding to the delivered or infed laps, in order to make it subsequently possible to insert the new laps manually in the unwinding position of the combing machine.

The empty tubes are then deposited on the transport or loading cradle of the transport truck and transported back to the lap formation machine.

With this exchange, or changing operation, it is necessary to intermediately store the empty tubes on the combing machine, in order to free a place for the subsequently introduced full laps.

This operation requires a considerable number of manual manipulations or operations and additionally is time consuming, as the laps must be deposited manually, singly and consecutively.

SUMMARY OF THE INVENTION

Therefore, with the foregoing in mind, it is an important object of the present invention to provide an improved transport device for laps which is not afflicted with the aforementioned shortcomings and drawbacks of the prior art.

Another and more specific object of the present invention aims at improving upon such types of systems in such a manner, that the semi- or fully automated exchange of the empty tubes for full tubes is undertaken in the shortest possible time.

Now in order to implement these and still further objects of the invention, which will become more readily apparent as the description proceeds, the transport device of the present development, among other things, is manifested by the features that the receiver, viewed transversely with respect to the longitudinal or lengthwise axis of the transport truck, is pivotably arranged at one side by means of a pivot axis or shaft and the pivoting of the receiver into a lower position simultaneously serves for the release of the lap or laps and the automatic transfer to the lap processing machine. This receiver is loaded or acted upon by a resilient or spring element in a direction opposite to the downwardly directed pivotal movement of such receiver and opposite to the direction of the action of the force exerted by the weight of the lap or laps reposing upon the receiver. A locking or fastening device serves to retain the receiver in an upper transport position. Beneath the receiver there is provided a receiver trough or channel for the empty tubes delivered by the lap processing machine. The length of the receiver trough or channel, arranged approximately parallel to the receiver, corresponds approximately to the length of such receiver.

Due to the provision of an additional receiver trough or channel for the empty tubes beneath the receiver for the laps, it is possible to simultaneously and completely automatically remove a number of empty tubes from the lap processing machine, specifically the combing machine, and to deliver such to the receiver trough of the transport truck or the like. The arrangement of a receiver which can be pivoted at one side thereof ensures that after release of the locking or fastening device, all of the laps which repose or lie in the receiver trough, can be simultaneously and automatically infed to the combing machine.

In order to simplify the operation, it is proposed to undertake release of the locking or fastening device by means of an unlocking or release device arranged at the lap processing machine.

The further proposal to arrange beneath the receiver for the laps a floor or base surface which is inclined outwards and downwards, ensures a functionally reliable rolling off or loading of the laps into the combing machine following pivoting of the receiver.

Furthermore, the proposed arrangement of the floor or base surface with respect to the receiver, wherein the laps do not come into supporting or bearing contact with the floor or base surface during transport, affords the beneficial result that, upon pivoting the receiver, there is realized an acceleration of the laps until they are seated upon the floor or base surface and can roll off to the combing machine. This acceleration of the laps affords a positive transfer of the laps to the combing machine.

The receiver is advantageously constructed from two mutually parallel tubes or rods which are interconnected with one another by transverse struts or equivalent structure. These tubes or rods are directed in the lengthwise direction of the transport truck or the like. One of the tubes or rods constitutes an axis of rotation for the second tube or rod. Due to this design, there is realized a simple and transport-reliable structure.

By virtue of arranging an infeed or delivery member, for instance, formed of sheet metal, which extends at an inclination upwardly from the receiver trough, there is realized, in conjunction with a pivotable roll-off or transfer member, such as a roll-off plate likewise formed of sheet metal and pivotably mounted at the combing machine, a nonproblematic outfeed or unloading of the empty tubes into the transport trough or channel of the transport truck or vehicle.

In this connection, it is conceivable to equip each combing head with a separate roll-off or transfer member or plate or to structure the roll-off or transfer member or plate such that it extends over the width of, for example, four combing heads.

The same also holds true for the additionally proposed ejection or ejector device for the empty tubes.

Under the expression "combing head", there is to be understood one of the number of units which is equipped with a combing device for combing out a lap.

The pivotable roll-off member or plate, during its upward pivoting motion, advantageously extends into the release mechanism of the locking device. Consequently, it is possible to undertake an automatic unlocking of the receiver, and at the same time, following the unlocking operation, the roll-off or rolling surface assumes a position which leads to the formation of an approximately continuous or closed and downwardly inclined roll track or path directed towards the combing machine, for the automatic infeed of the laps stored at the transport truck or vehicle.

Additionally, it is proposed to arrange the pivot axis of the roll-off or transfer member or plate, in relation to the unwinding direction of the lap, approximately at the height of and behind the lap rollers or rolls. In this context, the term "unwinding direction" is related to the unwinding operation, in other words, the infeed of the lap or lap web or bat during the combing operation. The lap rolls constitute the support rolls upon which there are supported the laps in the combing machine and by means of which these laps can unwind in order to be combed.

In order to obtain a partially automatic operation, it is further proposed to control the operation of the ejection device as well as the adjustment of the roll-off or transfer member by means of a suitable drive, such as a cylinder unit or cylinder means or an adjustment motor. As a result, it is possible for the operator or operating personnel to initiate the exchange operation of the tubes and the laps, respectively, simply by depressing a knob or other suitable actuation element, for example, at a control panel or console located at the front side of the combing machine. In order to achieve a fully automated operation of the exchange or change operation, it is further proposed that the roll-off or transfer member and the ejection device be actuated by a suitable drive, such as a cylinder unit or an adjustment motor, whereby the actuation devices are controllably mutually interconnected by a control unit with the control of a positioning element and a position-determining device of the transport truck as well as with a sensor for detecting or scanning the lap.

In order to lay out the entire transport system so as to operate completely automatically, it is further proposed that the transport truck or vehicle be equipped with its own drive. This transport vehicle is guided by a control processor over a guide track or guideway, which is operatively connected by a master computer with the control of the drive elements of the lap processing machine as well as with the control device or unit for the automatic exchange device.

BRIEF DESCRIPTION OF THE DRAWINGS

The above and additional objects, characteristics and advantages of the present invention will become apparent in the following detailed description of the preferred embodiments, with reference to the accompanying drawings which are presented as non-limiting examples in which.

DETAILED DESCRIPTION OF PREFERRED EMBODIMENTS

Describing now the drawings, it is to be understood that only enough of the construction of the transport device for laps and the related lap formation machine and lap processing machine, have been conveniently depicted therein, in order to simplify the illustration and as needed for those skilled in the art to readily understand the underlying principles and concepts of the invention.

Figure 1:
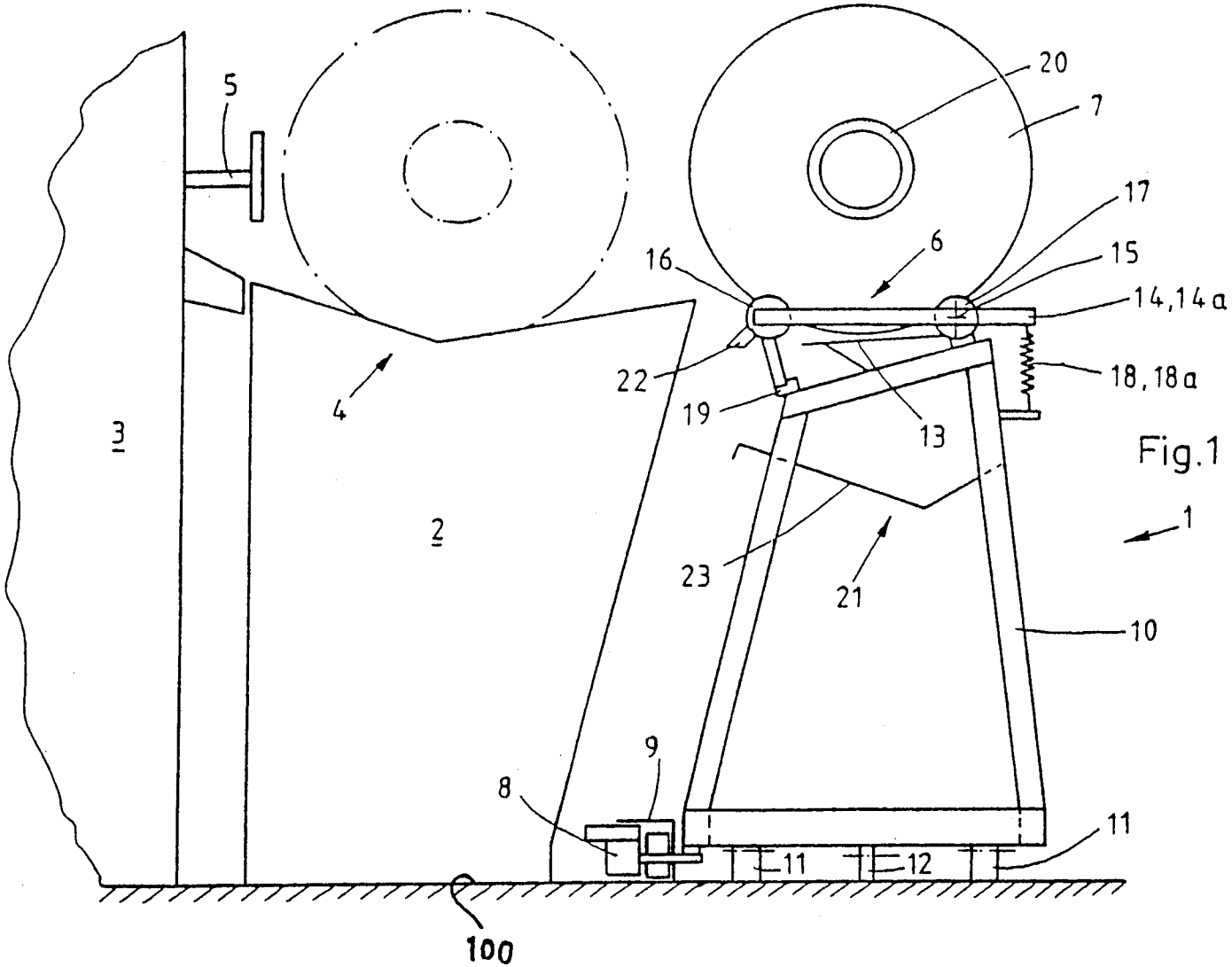
FIG. 1 is a schematic side elevational view of a lap transport truck or vehicle portrayed in a position during delivery or outfeed of a lap from a lap formation or forming machine onto the lap transport truck or vehicle.

Turning attention now specifically to FIG. 1, there is shown therein a mobile transport device, here depicted in the form of a transport truck or vehicle 1, which is in a fixed or defined position at a schematically illustrated delivery table 2 or the like of a conventional lap formation or forming machine 3. The transport truck 1 essentially comprises a frame or frame unit 10 which is supported by means of wheels 11 or steerable wheels 12 upon a floor or supporting surface 100. At its upper region, this transport truck 1 is provided with a receiver or receiving device 6 which is constituted by longitudinal tubes and rods 16 and 17 arranged in the lengthwise direction of the transport truck 1. These longitudinal or lengthwise extending tubes or rods 16 and 17 are interconnected with one another by means of tiltable levers or transverse struts 14 and 14a or equivalent structure. The longitudinal tube or rod 16 is mounted to be pivotable by means of the tiltable levers 14 and 14a so that this longitudinal tube 16 can perform pivotable movement about a pivot or tilt axis 15 of the longitudinal or lengthwise extending tube or rod 17. During transport, the laps 7 bear upon both of the longitudinal tubes or rods 16 and 17 at a lap support region 108 of the receiver 6. In this position both of the tiltable levers or transverse struts 14 and 14a are retained in their transport position by a suitable locking or fastening device 22. Additionally, there is operatively arranged at both of the tiltable levers 14 and 14a or the like an associated resilient element or spring 18 and 18a, respectively, which cause a pivoting of the receiver 6 in a direction opposite to the direction of application of the force exerted by the weight of the laps.

Secured beneath the receiver 6 at the vicinity of the lap support region 108 is a floor or base member or surface 13, for instance, formed of sheet metal. This floor or base member 13 is inclined with respect to the transfer direction of the laps 7 out of the transport truck 1. The laps 7 first arrive in contact with the floor or base member 13 after releasing the locking device 22 and following downward tilting of the longitudinal or lengthwise extending tube or rod 16.

This locking or fastening device 22, in the position illustrated in FIG. 1, bears upon a stop or impact member 19 of the frame or frame unit 10. Beneath the receiver or receiving device 6, there is arranged, essentially parallel thereto, a receiver trough or channel 21 for the reception of the empty tubes 20 or the like. The length of the receiver trough or channel 21 essentially corresponds to the length of the receiver 6. This receiver trough 21 is provided with an outwardly inclined and upwardly directed infeed or feed member or delivery plate 23, for instance, formed of sheet metal. This infeed or feed member 23 and the floor or base member 13 are arranged in converging relationship with respect to one another.

The delivery table 2 is provided with a trough or cradle or channel 4 in which come to rest the laps delivered by the lap formation machine 3.

If a finished lap 7 is located in this trough or cradle 4, then through the displacement of an ejection device, here shown as an ejection ram or punch 5, the finished lap 7 is transferred into the receiver 6, that is to say, is placed upon the longitudinal tubes or rods 16 and 17 of the positioned transport truck or vehicle 1.

Since at the lap forming machine 3, there is only delivered, in each instance, one lap 7, it is therefore necessary that the transport truck 1 be shifted in its lengthwise direction through the width of at least one lap at timewise intervals in order to properly load the transport truck or vehicle 1. This displacement or shifting of the transport truck 1, as a general rule, is undertaken by the amount of the pitch or gauge between the combing heads of the subsequent lap processing machine 25, here defining a combing machine by way of example.

This incremental displacement or shifting of the transport truck or vehicle 1 is accomplished by any suitable adjustment or operating mechanism 8, which need not therefore be further considered. The transport truck 1 is guided in lengthwise direction by a guide arrangement 9 in conjunction with suitable and thus not here illustrated guide elements mounted at the transport truck 1, to the delivery or outfeed location of the lap formation or forming machine 3.

In the exemplary embodiment under discussion, the lap transport truck or vehicle 1 is designed to receive four laps 7. After the fourth lap 7 has been placed upon the transport truck 1, the adjustment mechanism 8 is decoupled and the transport truck 1, together with the laps 7 carried thereby, can be displaced to the subsequently arranged lap processing machine, as noted above, the combing machine 25. This displacement can be accomplished either manually or automatically over a guide track or guideway system when the transport truck 1, as indicated in FIG. 2 by broken lines, is equipped with its own drive unit or drive 24.

Figure 2:
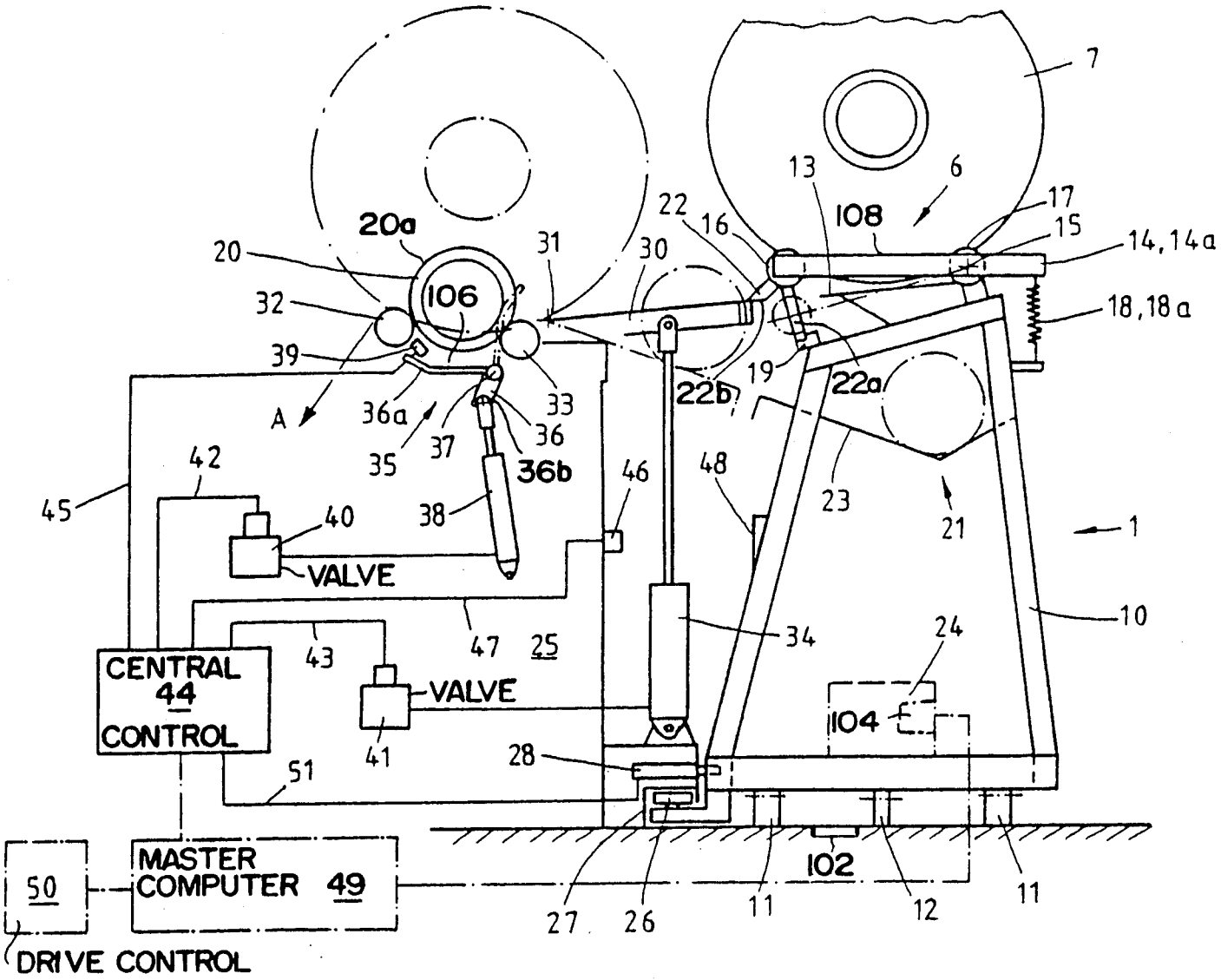
FIG. 2 is a schematic elevational side view of the transport truck or vehicle depicted in FIG. 1, shown positioned at a lap processing or take-up machine, here for instance typically a combing machine.

As best recognized by referring to such FIG. 2, the transport truck 1 is brought into a defined exchange or change position at the rear of the schematically indicated combing machine 25 by means of guide rolls or rollers 26 within a guide rail 27 which extends along the combing machine 25. If the transport truck 1, as also can be seen by referring to FIG. 3, for instance, has attained the appropriate position with respect to the individual combing heads, then it is automatically or manually fixed or locked in this position by a positioning element 28.

Figure 3:
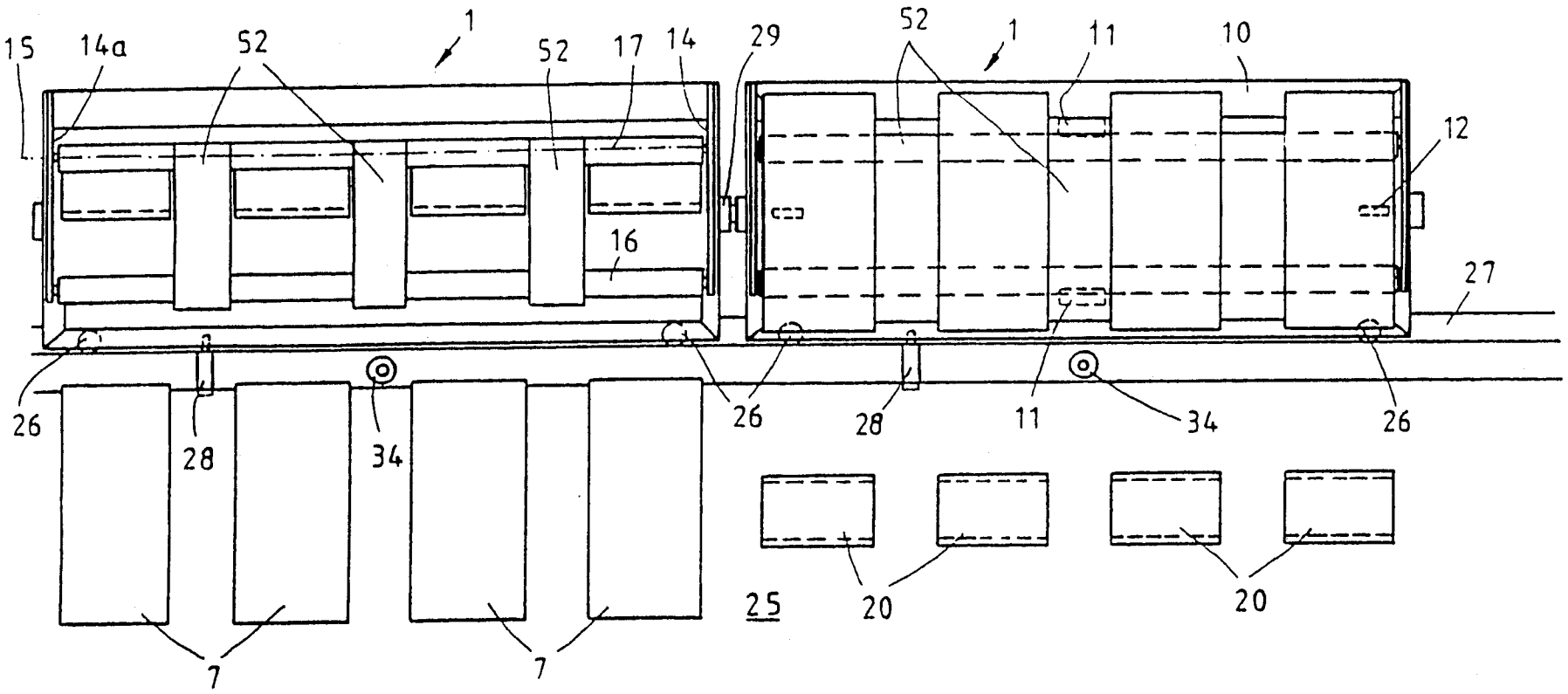
FIG. 3 is a top plan view of the arrangement of FIG. 2 on a smaller scale, depicting two intercoupled transport trucks or vehicles.

By further referring to FIG. 3, it will be recognized that in the embodiment shown two transport trucks 1 are in operation. These two transport trucks 1 are already located in a positioned exchange location at the combing machine 25, and both transport trucks 1 are interconnected with one another by a suitable coupling or connecting means 29.

For the exact lateral positioning of the laps 7 disposed in reposing relationship upon the transport truck 1, guide elements 52, for instance, formed of sheet metal, are disposed between the individual laps 7.

By reverting again to FIG. 2, it will be additionally observed that there are provided lap rolls or rollers 32 and 33 at a combing head of the combing machine 25 and upon which an associated lap 7 is placed in order to be unwound during the combing operation. The direction of the arrow A schematically indicates the direction of unwinding of the lap bat or web from the lap 7 and which is subsequently combed by any suitable and thus not shown combing device. A pivotable roll-off or transfer member or plate 30 is mounted behind the lap roll 33. This roll-off or transfer plate 30, which also may be formed of sheet metal or metal plating, can be positionally adjusted by a suitable drive, for instance a cylinder unit 34, for example a pneumatic cylinder. The unit 34 also may be constituted by an adjustment motor or equivalent structure.

Beneath both of the lap rolls 32 and 33, there is mounted an ejection device 35, here composed of a double-arm lever or lever member 36. This double-arm lever or lever member 36 is pivotably mounted about a pivot shaft 37 defining an axis of rotation. At the one end or arm 36b of the lever 36, there is articulated or otherwise appropriately connected a suitable drive or actuating device, here shown as a cylinder unit 38, but which also may be constituted by an adjustment motor, which effectuates the desired pivotable movement of the double-arm lever 36. During this pivoting of the double-arm lever 36, the other arm or arm member 36a thereof arrives between both of the lap rolls 32 and 33, and thus, causes the removal of the empty tubes 20. By providing an appropriate arrangement of the pivot shaft 37 defining the rotational or pivot axis for the lever 36, there is simultaneously ensured that the empty tubes 20 will be ejected in the direction of the roll-off or transfer member or plate 30.

Beneath the lap roll 32 there is secured a sensor 39 which appropriately signals the depletion of the lap upon the associated lap tube 20.

The control or actuation of the cylinder unit 38 is accomplished by a valve 40 and the control or actuation of the cylinder unit 34 by a valve 41.

These valves 40 and 41 or equivalent structure are connected by appropriate lines or conductors 42 and 43, respectively, with a central control unit 44. The sensor 39 is operatively connected by a line or conductor 45 with the central control unit 44 and a sensor 46 is connected with the central control unit 44 by means of a line or conductor 47. The sensor 46 serves for the longitudinal positioning of the transport truck or vehicle 1 at its proper location along side of the combing machine 25. This positioning sensor 46 cooperates with a contact surface 48 or equivalent structure provided for the transport truck 1. This sensor 46 could also be constructed as a mechanical switch which is actuated by the transport truck or vehicle 1.

As indicated in broken lines in FIG. 2, during the fully automated operation, the transport truck or vehicle 1 is provided with its own drive or drive means 24. This transport truck 1 is thus guided by means of a not here further shown sensor along and over a predetermined guideway or guidetrack, generally indicated by reference numeral 102 in FIG. 2. The drive or drive means 24 and its control, such as a control processor 104, are operatively connected by a master computer 49 with the central control unit 44. Equally, the drive control 50 of the drive units for the combing machine 25 is operatively connected with the master computer 49.

Having now had the benefit of the foregoing description of the transport device for laps, the mode of operation will be considered and is as follows:

As already described with reference to FIG. 1, after the transport truck 1 has been loaded with four laps 7 by the action of the ejection ram or punch 5, this loaded transport truck 1 is then placed manually or automatically by means of the guidetrack 102 at the rear or delivery side of the combing machine 25 which accepts the full laps 7. During this operation and as will be apparent by referring to FIG. 3, there also can be simultaneously conveyed two transport trucks 1 to the rear or rear side of the combing machine 25, these two transport trucks 1 being intercoupled by the coupling 29. Each transport truck 1 is provided at the lower side region thereof with the guide rolls 26 arranged at an appropriate spacing from one another and which are introduced into the guide rail 27 of the combing machine 25. As a result, the transport truck or transport trucks 1, as the case may be, are aligned essentially parallel to the combing machine 25 and to the individual combing heads. The alignment in longitudinal or lengthwise direction, in other words, into the transfer position with respect to the individual combing heads, is accomplished by the sensor 46 which cooperates with the contact surface 48 of the transport vehicle 1. If a signal is received by the sensor 46, then the transport vehicle 1 is engaged by the positioning element or device 28 which fixes the desired position of the transport truck or vehicle 1. This positioning element 28 is connected by a line or conductor 51 with the central control unit 44. In this regard, it is possible to implement simpler solutions, such as having the transport truck or vehicle 1 positioned properly along side the combing machine 25 through the use of a terminal stop which is operatively connected with a suitable locking element.

The transport truck or vehicle 1 is now located in a defined exchange or change position for the laps 7 and the tubes 20.

As will be observed by inspecting FIG. 2, a lap is no longer wound upon the tube 20, in other words, this tube 20 has been depleted. This lap depletion is indicated either manually, or as for the illustrated embodiment, determined by the sensor 39. As far as the sensor 39 is concerned, such may be constituted by a light-/dark sensor which then delivers an appropriate signal when the white lap web or bat has run off the dark or black structured tube surface 20*a*.

The roll-off or transfer member or plate 30 is then controlled by the pneumatic cylinder 34 or equivalent structure, automatically or manually with the aid of the valve or valve means 41 and then pivoted into the lower chain-dot line position of FIG. 2. Once this downwardly inclined position has been reached, something which also can be detected by a suitable sensor, then the cylinder unit 38 is operated manually or automatically, with the aid of the valve or valve means 40, and effectuates pivoting of the arm 36*a* of the double-arm lever 36, so that the empty tubes 20 can be transferred to the roll-off or transfer member 30. In the depicted exemplary embodiment four empty tubes 20 are simultaneously ejected. These empty tubes 20 automatically roll upon the roll-off or transfer member 30 and the delivery of feed plate 23, collectively forming almost a continuous roll path, into the receiver trough or cradle 21 of the transport truck 1 and come to rest at that location.

Thereafter the roll-off or transfer member 30 is pivoted with the aid of the pneumatic cylinder unit 34 into the illustrated upper position, with the result that it operates the locking or fastening device 22 of the receiver 6 and specifically the tiltable levers or transverse struts 14 and 14*a*. During this release operation when the roll-off plate 30 acts upon the arm 22*b*, defining a release mechanism, of the locking device 22, the locking action at the stop 19 is eliminated. By virtue of the weight of each lap 7, amounting in each case to as much as 25 kilograms or more, the tiltable levers 14 and 14*a* and the longitudinal tube or rod 16, located at the pivotable end portion of the receiver 6, are pivoted against the spring force of the springs 18 and 18*a* about the pivot axis 15 into the lower position depicted with chain-dot lines in FIG. 2. Since the laps 7, in their transport position, do not contact the floor or base surface 13 arranged below these laps 7, upon lowering of the longitudinal or lengthwise extending tube or rod 16 these laps 7 have imparted thereto an acceleration until they come to bear upon the floor or base surface 13. In this way, there is beneficially insured that the laps 7, during the transfer operation, positively roll off the transport truck or vehicle 1 in the direction of the combing machine 25.

By virtue of the inclined position of the floor or base surface 13 and the roll-off or transfer member 30, defining an almost continuous roll path, the laps 7 roll into the receiving area 106 between both of the lap rolls 32 and 33. Shortly before this happens, the arm 36*a* of the tube ejection device 35 is again pivoted into the depicted lower position. After the placement of the laps 7, the roll-off or transfer member 30 is again pivoted into its lower position shown in chain-dot lines, and the locking device 22, which is likewise equipped with a suitable resilient element or spring, is returned by such spring action back into its locking position. This is accomplished by returning the tiltable levers 14 and 14*a*, by the action of the resilient elements or springs 18 and 18*a*, respectively, into the full line depicted position, wherein the arm or arm member 22*a* of the locking device 22 again comes to bear at the associated stop or impact member 19, and thus, assumes a fixed locking position.

As will be recognized by referring to FIG. 3, the exchange of the empty tubes 20 for the full laps 7 has already been accomplished at the transport truck or vehicle 1 located at the left-hand side of FIG. 3, whereas this exchange operation has not yet been undertaken at the right-hand located transport truck 1. This exchange operation, in other words, the replacement of the empty tubes 20 with the full laps 7, can be either accomplished manually by means of a control console or panel, semi-automatically by means of the central control unit 44 or fully automatically by means of the master computer 49. When using a master computer 49, there is also operated the drive control 50 for the drive units of the combing machine 25, in other words, the operating personnel only have assigned the task of performing monitoring functions. A fundamental condition for this fully automatic operation requires that there be performed an automatic piecing of the lap undergoing depletion with the newly-infed full lap 7.

After completion of the exchange operation, there is released the positioning element 28, in other words, the transport truck or transport trucks 1 are again free to move and can be manually or automatically shifted out of the guide rail 27. The empty cops 20 are then returned to the lap formation or forming machine 3, where they are placed either manually or automatically into the lap formation machine 3. The lap transport operation and the exchange operation involving the full laps 7 for the empty tubes 20 now can begin anew.

By means of the proposed transport and exchange system, there is realized an appreciable simplification of the lap and tube exchange operations, in other words, the manual interventions are reduced to a minimum, and in the case of fully automated operations, the activities of the operating personnel are basically limited to very few monitoring functions. It is to be appreciated that there is realized a simultaneous reception or take-up of a plurality of lap, tubes 20, and there is no longer required any intermediate storage of these lap tubes 20 during placement of the full laps 7. Additionally, it is possible for the operating personnel to perform the entire exchange operation from the locality of a central position in front of the combing machine 25.

Finally, although the invention has been described with reference to particular means, materials and embodiments, it is to be understood that the invention is not limited to the particulars disclosed and extends to all equivalents within the scope of the claims.

What is claimed:

1. A transport device for the delivery of a plurality of tubes wound with textile material to form laps, from a lap forming machine to a lap processing machine by means of a transport truck, comprising:

a lap forming machine for forming laps;

a lap processing machine for processing the formed laps;

a transport truck for conveying the laps between the lap forming machine and the lap processing machine;

said transport truck being provided with receiver means for reposingly receiving the laps;

said transport truck having a lengthwise direction;

said laps, viewed in the lengthwise direction of the transport truck, being arranged behind one another and coaxially with respect to one another at a predetermined spacing from one another in the receiver means;

means for fixing the transport truck in a predetermined position for delivery of the laps from the transport truck to the lap processing machine;

said transport truck having a lengthwise axis;

means defining a pivot axis for pivotably mounting said receiver means at one side thereof for pivotal movement in a direction substantially transverse with respect to the lengthwise axis of the transport truck;

said receiver means being downwardly pivotable into a lower position for the simultaneous release of the laps and for automatically transferring the laps to the lap processing machine;

resilient means co-acting with said receiver means for acting upon said receiver means in a direction opposite to the downward pivotable movement and against the direction of a force exerted by the weight of the laps reposing in the receiver means;

a locking device for retaining the receiver means locked in an upper transport position;

a receiver trough disposed beneath the receiver means;

said receiver trough receiving empty tubes delivered by the lap processing machine;

said receiver trough being disposed approximately parallel to said receiver means;

said receiver means possessing a predetermined length;

said receiver trough possessing a predetermined length; and said predetermined length of said receiver trough corresponding approximately to said predetermined length of said receiver means.

2. The transport device as defined in claim 1, further including:

actuatable unlocking means for opening the locking device.

3. The transport device as defined in claim 2, wherein:

said actuatable unlocking means comprise manually actuatable unlocking means.

4. The transport device as defined in claim 2, wherein:

said actuatable unlocking means comprise automatically actuatable unlocking means.

5. The transport device as defined in claim 1, wherein:

said receiver means possesses a support region for the laps;

means defining a floor surface arranged beneath the receiver means at least at the vicinity of the support region for the laps;

said means defining said floor surface extending at an inclination outwardly and downwardly;

said receiver means having a pivotable end portion; and said means defining said floor surface extending at an inclination outwardly and downwardly transversely with respect to the lengthwise axis of the transport truck as viewed from the pivot axis of the receiver means in the direction of the pivotable end portion of the receiver means.

6. The transport device as defined in claim 5, wherein:

said means defining said floor surface has a spacing in relation to the receiver means such that in the locked transport position of the receiver means the laps reposing upon said receiver means fail to bear at their outer circumference upon the floor surface.

7. The transport device as defined in claim 1, wherein:

said receiver means comprise two substantially parallel and spaced rods extending in the lengthwise direction of the transport vehicle;

transverse struts for interconnecting said rods; and one of said rods being fixedly arranged and defining said pivot axis about which there is pivotable the other rod.

8. The transport device as defined in claim 1, wherein:

said receiver trough comprises an upwardly inclined and outwardly directed delivery plate;

a roll-off plate for the laps pivotably arranged at the lap processing machine;

said roll-off plate being movable between an upper position and a lower position; and said delivery plate forming in conjunction with said roll-off plate, when said roll-off plate is in said lower position, an approximately continuous roll-off surface for the infeed of empty tubes, delivered by the lap processing machine, to the transport truck.

9. The transport device as defined in claim 8, further including:

an ejection device provided for the lap processing machine; and said ejection device serving to eject empty tubes for placement upon the receiver trough.

10. The transport device as defined in claim 8, wherein:

said locking device for said receiver means includes a release mechanism;

said pivotable roll-off plate having a pivot axis;

said pivotable roll-off plate when moving from said lower position into said upper position coming to lie in an actuation region of the release mechanism of the locking device of the receiver means; and said pivotable roll-off plate, following release of the locking device, and as viewed from the pivot axis of said roll-off plate in the direction of the transport truck, assuming an upwardly directed position and forming in conjunction with said floor surface an approximately continuous roll path for the automatic infeed of the laps.

11. The transport device as defined in claim 10, further including:

lap roll means provided for the laps;

said pivot axis of the roll-off plate, as viewed with respect to a predetermined unwinding direction of the laps, being arranged approximately at the elevation of and behind the lap roll means; and a pivotable ejection device arranged beneath the lap roll means and effective in a direction towards the transport truck.

12. The transport device as defined in claim 11, wherein:

said ejection device comprises a pivotably mounted double-arm lever having a pair of arms; and actuation means for the double-arm lever operatively connected with one of the arms thereof.

13. The transport device as defined in claim 12, wherein:

said actuation means comprise a cylinder unit.

14. The transport device as defined in claim 12, wherein:

said actuation means comprises adjustment motor means.

15. The transport device as defined in claim 8, further including:

actuation means provided for said roll-off plate.

16. The transport device as defined in claim 15, wherein:

said actuation means comprise cylinder means.

17. The transport device as defined in claim 15, wherein:

said actuation means comprise adjustment motor means.

18. The transport device as defined in claim 1, further including:

means for determining the position of the transport truck along a predetermined path of travel; and said means for fixing the transport truck serving to positionally fix the transport truck at a desired location along said predetermined path of travel of the transport truck.

19. The transport device as defined in claim 9, further including:

means for actuating pivoting of the roll-off plate and said ejection device;

sensor means for sensing unwinding of laps;

control means; and said means for determining the position of the transport truck, said actuation means for pivoting of the roll-off plate and the ejection device and said sensor means for sensing unwinding of the laps being interconnected with one another by said control means.

20. The transport device as defined in claim 19, further including:

drive control means for the lap processing machine; and said drive control means being connected with said control means.

21. The transport device as defined in claim 19, wherein:

said transport truck comprises a driverless transport vehicle guided over a guidetrack;

said driverless transport vehicle being provided with a control processor;

master computer means; and said control processor of said transport vehicle being operatively connected with said control means by means of said master computer means.

22. The transport device as defined in claim 1, further including:

coupling means for intercoupling a plurality of transport trucks with one another.

* * * * *